US011022034B2

(12) United States Patent
Fisher

(10) Patent No.: US 11,022,034 B2
(45) Date of Patent: Jun. 1, 2021

(54) SYSTEMS FOR CLEANING INTERNAL COMBUSTION ENGINE INTAKE VALVES

(71) Applicant: Ethan Fisher, Olympia, WA (US)

(72) Inventor: Ethan Fisher, Olympia, WA (US)

( * ) Notice: Subject to any disclaimer, the term of this patent is extended or adjusted under 35 U.S.C. 154(b) by 0 days.

(21) Appl. No.: 16/658,071

(22) Filed: Oct. 19, 2019

(65) Prior Publication Data

US 2021/0115847 A1 Apr. 22, 2021

(51) Int. Cl.

| | |
|---|---|
| ***F02B 77/04*** | (2006.01) |
| ***F02M 35/10*** | (2006.01) |
| ***B08B 9/027*** | (2006.01) |
| ***F02M 35/104*** | (2006.01) |

(52) U.S. Cl.

CPC ..... *F02B 77/04* (2013.01); *B08B 9/027* (2013.01); *F02M 35/104* (2013.01); *F02M 35/10229* (2013.01); *F02M 35/10255* (2013.01); *F02M 35/10386* (2013.01)

(58) Field of Classification Search

CPC .... F02B 77/04; F02B 2077/045; B08B 9/027; F02M 35/10229; F02M 35/10209; F02M 35/104; F02M 35/10255; F02M 35/10386

See application file for complete search history.

(56) References Cited

U.S. PATENT DOCUMENTS 1,409,786 A * 3/1922 Sansbury ..... F02B 77/04 123/198 A
2,281,695 A * 5/1942 James ..... F02B 77/04 134/23
3,173,408 A * 3/1965 Brenneman ..... F01M 13/02 123/25 G
4,425,937 A * 1/1984 Stein ..... F02B 77/04 137/480
4,989,561 A * 2/1991 Hein ..... F02B 77/04 123/198 A
5,097,806 A * 3/1992 Vataru ..... F02B 77/04 123/198 A
5,503,683 A * 4/1996 Butcher ..... B08B 9/0323 123/198 A
5,826,602 A * 10/1998 Chen ..... F02B 77/04 134/20
6,000,413 A * 12/1999 Chen ..... F02B 77/04 134/102.2
6,073,638 A * 6/2000 Sasaki ..... F02B 77/04 134/102.2
6,178,977 B1 * 1/2001 Wells ..... F02B 77/04 134/102.1
6,192,901 B1 * 2/2001 Rome ..... B60S 3/047 123/198 A
6,357,674 B1 * 3/2002 Nakashima ..... F02B 77/04 239/309
6,652,667 B2 * 11/2003 Ahmadi ..... F02B 77/04 134/36

(Continued)

FOREIGN PATENT DOCUMENTS

| | | |
|---|---|---|
| CN | 203717124 U | 7/2014 |
| WO | 2015089866 A1 | 6/2015 |

*Primary Examiner* — Hung Q Nguyen

(57) ABSTRACT

A system including a solvent in fluid communication with the air intake valves of an internal combustion engine. The internal combustion engine generating a vacuum to cause the solvent to disperse into the air intake manifold of the internal combustion engine.

16 Claims, 1 Drawing Sheet

(56) References Cited

U.S. PATENT DOCUMENTS

| | | | | |
|---|---|---|---|---|
| 6,655,392 | B2 * | 12/2003 | Erwin | F02B 77/04 123/1 A |
| 6,892,691 | B1 * | 5/2005 | Uhl | F02D 41/0085 123/198 A |
| 7,231,930 | B1 * | 6/2007 | Stedam | F02M 21/0227 134/169 A |
| 8,926,763 | B2 * | 1/2015 | Ogasawara | F02M 35/10242 134/22.1 |
| 9,726,079 | B2 * | 8/2017 | Wicks | B08B 9/027 |
| 9,752,499 | B2 * | 9/2017 | Liu | B08B 9/0865 |
| 10,132,239 | B2 * | 11/2018 | Liu | F02B 77/04 |
| 2008/0060680 | A1 * | 3/2008 | Esterline | B08B 3/00 134/22.1 |
| 2010/0115721 | A1 * | 5/2010 | Gugaratshan | F02B 77/04 15/104.011 |
| 2016/0215690 | A1 * | 7/2016 | Thompson | F02B 77/04 |
| 2017/0248075 | A1 * | 8/2017 | Nemeth | F02B 77/04 |
| 2018/0363549 | A1 * | 12/2018 | Huang | F02B 77/04 |

* cited by examiner

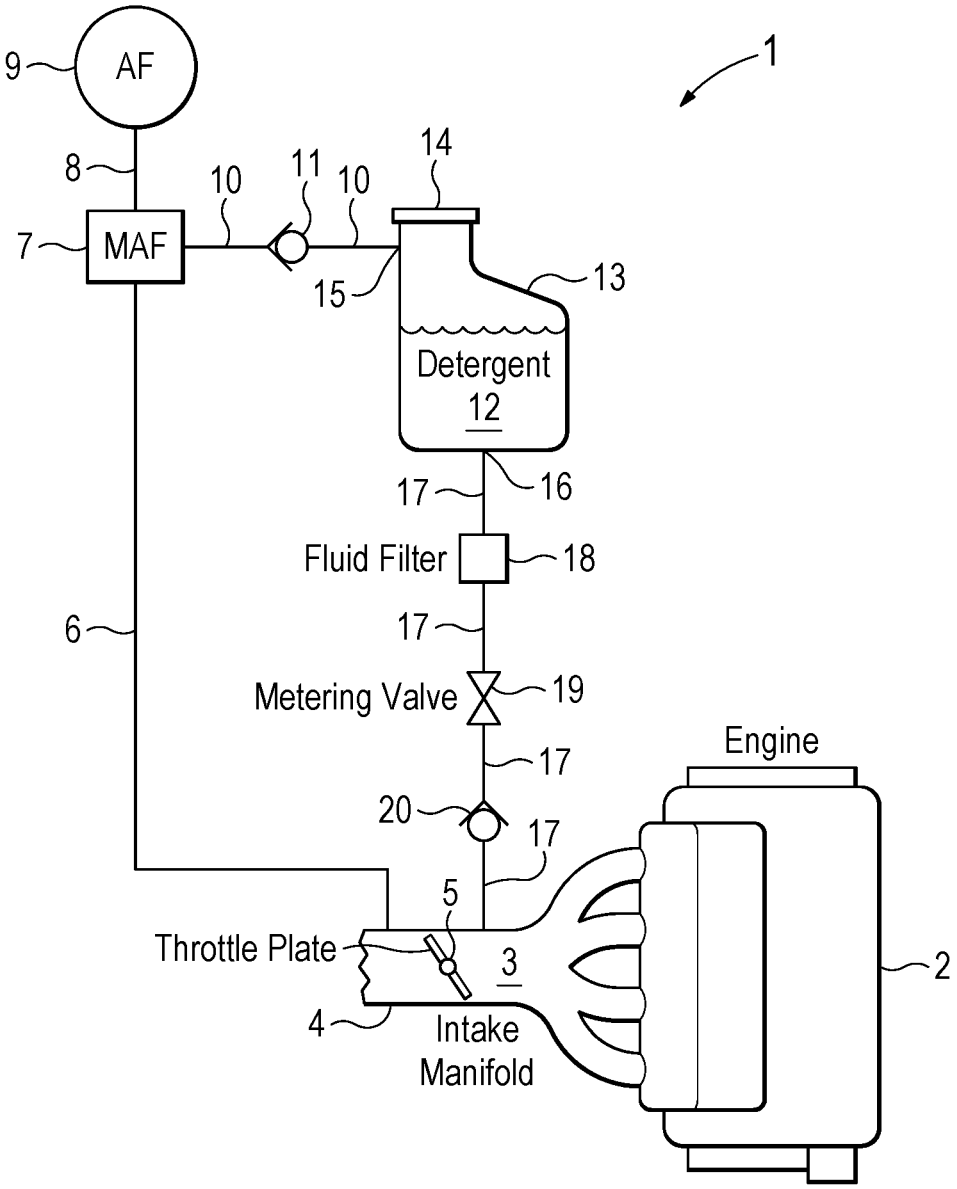
1
9
AF
8
7
MAF
10
11
10
14
15
13
Detergent
12
17
16
Fluid Filter
18
17
6
Metering Valve
19
17
Engine
20
17
5
Throttle Plate
3
2
4
Intake
Manifold

SYSTEMS FOR CLEANING INTERNAL COMBUSTION ENGINE INTAKE VALVES

BACKGROUND

Carbon deposits are a natural by-product of the process of burning gasoline in internal combustion engines. Buildup of carbon deposits, especially in direct injection spark ignition internal combustion engines can rob the system of power, performance, and fuel economy. Direct injection spark ignition internal combustion engines have a tendency to collect unwanted carbon deposits in the rounded corners of the intake valve and the deposits can break off and fall into the intake tract, causing damage to the valves and internals.

The piling on of additional layers of carbon deposited on top of one another worsens over time, restricting the air intake path and therefore reduces the mass airflow to the cylinders. In addition, variable valve timing through cam phasing tends to exacerbate buildup of carbon deposited immediately upstream from the intake valve. This is because hot combustion gases are forced unwantedly upstream from the combustion chamber into the air intake flow path.

Detergents and other additive packages are added to the fuel in gasoline internal combustion engines to prevent formation of and to remove deposits which are formed by the heavy components of the fuel. In order for these detergent additives in the fuel to remove deposits from the various parts of an internal combustion engine, they need to come into contact with the parts that require cleaning. However, specific internal combustion engine configurations have more pronounced problematic deposit areas due to the intake systems. For example, throttle body style fuel injector systems and port fuel injection spark ignition internal combustion engines where the fuel is sprayed at the initial point of airflow into the system allow the intake to remain reasonably clean using the fuel additive. However, direct injection spark ignition internal combustion engines that spray the fuel directly into the combustion chamber are subject to increased formation of unwanted deposits from hydrocarbons. In addition, upstream internal combustion engine air flow components can remain with internal combustion engine deposits even though a detergent is used in the fuel. Even with the use of detergents, some internal combustion engine components when present, such as, inter alia, intake valves, fuel injector nozzles, idle air bypass valves, throttle plates, exhaust gas recirculation valves, positive crankcase valve systems, combustion chambers, and oxygen sensors require additional cleaning.

Cleaning systems that require the vehicle to be taken out of service for some length of time require at least some degree of disassembly of the internal combustion engine and the air induction system. The cleaning service, including the disassembly, is performed by trained and highly-skilled technicians at the expense of the owner of the vehicle. In order to physically clean the carbon deposits from the intake ports and intake valves, the factory intake manifold is removed so that the technician can access each port and each valve. The carbon deposit cleaning is performed by rotating the internal combustion engine so that the corresponding intake valves are closed, allowing the technician to ensure that no debris fall into the combustion chamber and all carbon deposits can be carefully collected. Thus, an effective way to remove carbon buildup from the intake valves and intake ports is to remove the intake manifold and physically clean the valves. Automotive manufacturers recommend this time-consuming, labor-intensive, and expensive service be performed by a professional repair facility.

It has been discovered that operating cleaning systems for removing unwanted carbon deposits from an airflow path of an internal combustion engine and reducing carbon buildup already deposited in the intake valves of the internal combustion engine, while the internal combustion engine is idling, can transform the capabilities of air induction systems and cleaning detergents, which, in turn, can transform the entire cleaning system from simply a more-convenient way of doing something to something even more desirable, affordable, and marketable.

SUMMARY

In an embodiment, a cleaning system relates to systems for cleaning unwanted carbon deposits from an airflow path of an internal combustion engine and reducing carbon buildup already deposited in the intake valves of the internal combustion engine while the internal combustion engine is idling.

According to another embodiment, a system includes a reservoir attachable to an air intake system of an internal combustion engine. The reservoir includes a solvent in fluid communication with at least an air intake valve of the internal combustion engine and an air draw orifice in one-way fluid communication with a mass airflow sensor of the air intake system. In operation of the internal combustion engine, vacuum causes the solvent to flow from the reservoir into an air intake manifold of the internal combustion engine.

Naturally, further objects of embodiments are disclosed throughout other areas of the specification, drawings, photographs, and claims.

BRIEF DESCRIPTION OF THE DRAWINGS

Corresponding reference numerals indicate corresponding parts throughout the several views of the drawings.

FIG. 1 is a schematic view of an embodiment of a cleaning system according to the present disclosure.

Drawings included as part of the present disclosure are for illustrative purposes only of select embodiments and not all possible implementations, and are not intended to limit the scope of the present disclosure.

DETAILED DESCRIPTION

The claimed subject matter is described with reference to the drawing or drawings, wherein like reference numerals are used to refer to like structures throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in block diagram form in order to facilitate describing the subject innovation. Moreover, it is to be appreciated that the drawing or drawings may not be to scale.

According to embodiments of the present disclosure, cleaning system 1 relates to systems for cleaning unwanted carbon deposits from an airflow path of an internal combustion engine 2, as well as reducing carbon buildup already deposited in the intake valves of the internal combustion engine 2 while the internal combustion engine 2 is under vacuum and idling.

FIG. 1 is a schematic, illustrating an embodiment of the cleaning system 1, including a four-cylinder internal combustion engine 2. The illustrative example of the internal combustion engine 2 is not intended to preclude embodiments which incorporate any number of cylinders, currently or prospectively available. Although automotive internal combustion engines are exemplified in the present disclosure, the embodiments disclosed herein for their use are not limited to such, but can be used in other internal combustion engines including commercial trucks and vans, boats, and stationary internal combustion engines, inter alia.

Cleaning system 1 includes an intake manifold 3 having four intake runners, supplying intake into a cylinder of the internal combustion engine 2. Intake air is supplied to the intake manifold 3 via throttle body 4 having a throttle plate 5, which are downstream from a mass airflow (MAF) sensor 7 associated with an air filter (AF) 9. Commercially available tubing 6 and 8, including sensor tubes ranging between 1 and a half inches up to more than five inches can be used to couple components, such as the MAF 7 to other components, such as the intake manifold 3 within the airflow path.

In an embodiment, a charge air cooler can, but not necessarily, be disposed upstream from the intake manifold 3 in association with a turbo charger or a super charger. The example of the charge air cooler and associated turbo charger or super charger are not intended to preclude embodiments which incorporate similar or equivalent water-to-air heat exchangers, currently or prospectively available.

Detergent 12 can be a liquid solvent formulated to clean deposits and undesirable contaminants that form within the air induction system during normal vehicle operations. The term "solvent" means any solution or formulation intended to dissolve, neutralize, or otherwise remove any type of undesired material that may be present within the airflow path of the vehicle powertrain. The solvent can be a cleaning composition, or a plurality of cleaning compositions applied sequentially, depending on the mass of the compositions.

The cleaning system 1 can include a detergent reservoir 13 for storing the detergent 12. The detergent reservoir 13 can be square, cylindrical or of any suitable shape, and manufactured of any chemically resistant material that is translucent for visibly determining the quantity and flowrate of detergent 12 dispensed. In an embodiment, a graduated or otherwise marked detergent reservoir 13 with a fill port 14 can be utilized to aid in control of the fluid addition/refill.

Detergent reservoir 13 can be mounted onboard the vehicle, preferably within or adjacent to the vehicle internal combustion engine 2. A first check valve 11, disposed between MAF 7 and the detergent reservoir 13, near the fill port 14 and above the fill line of the detergent reservoir 13, can draw air into the detergent reservoir 13 from the MAF 7. Air drawn from the MAF 7 is prevented from returning into the MAF 7 by first check valve 11. Next, the air can be drawn to the internal combustion engine 2 along the mass airflow path of the air induction system (MAF 7 to throttle body 4 via tubing 6) of the internal combustion engine 2. The description supra and illustrative example in FIG. 1 of the check valve 11 are not intended to preclude embodiments which incorporate similar or equivalent, currently or prospectively available non-return valves or one-way valves that normally allow fluid to flow in only one direction.

Barb fitting 15 in conjunction with tubing 10 can be used to provide the airflow path from the detergent reservoir 13 to first check valve 11. Commercially available tubing 10, including three eighths inch hose tubing can be used between the barb fitting 15 and first check valve 11, as well as between the first check valve 11 and MAF 7. The descriptions supra and illustrative examples in FIG. 1 of both the barb fitting 15 and tubing 10 of the cleaning system 1 are not intended to preclude embodiments which incorporate similar or equivalent, fittings, clamps, and hoses currently or prospectively available.

Detergent 12 is transferred from the detergent reservoir 13 to intake manifold 3 under vacuum, while the internal combustion engine 2 is idling and not making power. Internal combustion engine suction (i.e., vacuum generated by a running internal combustion engine) is used to dispense the detergent 12 from the detergent reservoir 13 when the vehicle is idling and connected to a vacuum port of the internal combustion engine 2. The detergent reservoir 13 can, but not necessarily, include a flexible or fixed siphon tube 16 extending downward terminating towards the bottom of the detergent reservoir 13. The siphon tube 16 is in fluid contact with the detergent 12 contained within the detergent reservoir 13. The siphon tube 16 can be fixed to the wall of the detergent reservoir 13, or freely removable from the fill port 14. The siphon tube 16, upon exiting the detergent reservoir 13, is connected to a fluid filter 18 and a metering valve 19, which can be used for flow proportioning. The detergent 12 is in communication with a flexible conduit or hose 17 having the proximal portion fitted and/or clamped to the siphon tube 16. The distal portion of the flexible conduit 17 is connected to a second check valve 20, which is connected to the intake manifold 3.

The description supra and illustrative example in FIG. 1 of the metering valve 19 and second check valve 20 are not intended to preclude embodiments which incorporate similar or equivalent, currently or prospectively available flow proportioning valves and non-return valves or one-way valves that normally allow fluid to be proportioned and flow in only one direction.

In an embodiment of the present disclosure, the intake manifold 3 is designed to allow for uniform distribution of the detergent 12 inside the runners and ports of the air induction system. In another embodiment, delivery of the detergent 12 to the internal combustion engine 2 can also consist of multiple tubes attached to the flexible conduit 17 where the multiple tubes can be directed dependently or independently to the desired treatment location either through the same or different vacuum points at the intake manifold 3. These multiple tubes can, but not necessarily, have holes or orifices machined along their length to dispense detergent 12 to a single or to multiple intake ports. The multiple tubes can be constructed of various internal diameters to compensate for the variable vacuum motive force and flow profile at the various orifices.

The description of the embodiments has been provided for purposes of illustration and description, it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the FIGURE. Spatially relative tern may be intended to encompass different orientations of the device in use or operation in addition to the orientation depicted in the FIGURE. For example, if the device in the FIGURE is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A system, comprising:

a reservoir attachable to an air intake system of an internal combustion engine of a vehicle; the reservoir comprising:

a solvent in fluid communication with at least an air intake valve of the internal combustion engine;

an air draw orifice in one-way fluid communication with a mass airflow sensor of the air intake system;

a one-way valve having an entry port and exit port, wherein the system, operably coupled to the internal combustion engine while the vehicle is in motion and being driven, in response to a vacuum generated by an operation of the internal combustion engine disperses the solvent into an air intake manifold of the internal combustion engine, the system in operation not connected to any external power source nor requiring any human labor.

2. The system of claim 1, wherein the air intake manifold comprises a vacuum port.

3. The system of claim 2, further comprising a metering valve having an inlet and an outlet, the inlet of the metering valve connected to the reservoir.

4. The system of claim 3, wherein the entry port of the one-way valve is connected to the outlet of the metering valve.

5. The system of claim 4, wherein the exit port of the one-way valve is connected to the air intake manifold.

6. The system of claim 5, further comprising a fluid filter.

7. The system of claim 6, wherein the fluid filter is in fluid communication between the reservoir and the metering valve.

8. The system of claim 7, further comprising a plurality of flexible conduit.

9. A system of cleaning an internal combustion engine of a vehicle having a vacuum port in communication with an air intake manifold, comprising:

a solvent in fluid communication with at least an air intake valve of the internal combustion engine;

a metering valve having an inlet and an outlet;

a one-way valve having an entry port and exit port, the entry port connected to the outlet of the metering valve and the exit port connected to the air intake manifold, wherein the system, operably coupled to the internal combustion engine while the vehicle is in motion and being driven, in response to a vacuum generated by an operation of the internal combustion engine disperses the solvent into the air intake manifold of the internal combustion engine, the system in operation not connected to any external power source nor requiring any human labor.

10. The system of claim 9, further comprising a reservoir attachable to an air intake system of the internal combustion engine of the vehicle.

11. The system of claim 10, wherein the reservoir comprises the solvent.

12. The system of claim 11, wherein the reservoir comprises an air draw orifice in one-way fluid communication with a mass airflow sensor of the air intake system.

13. The system of claim 9, further comprising a fluid filter.

14. The system of claim 13, wherein the fluid filter is in fluid communication between the reservoir and the metering valve.

15. The system of claim 9, further comprising a plurality of flexible conduit.

16. An engine cleaner system attachable to an air intake system of an internal combustion engine of a vehicle for introducing a solvent into an air intake manifold of the air intake system, comprising:

a first one-way valve in fluid communication between the solvent and the air intake system;

a metering valve;

a second one-way valve in fluid communication between the metering valve and the air intake manifold, wherein the solvent in fluid communication with at least an air intake valve by way of passing through the metering valve and then the second one-way valve, wherein the system, operably coupled to the internal combustion engine while the vehicle is in motion and being driven, in response to a vacuum generated by an operation of the internal combustion engine disperses the solvent into the air intake manifold of the internal combustion engine, the system in operation not connected to any external power source nor requiring any human labor.

* * * * *